United States Patent [19]

Bouchon et al.

[11] Patent Number: 4,735,028

[45] Date of Patent: Apr. 5, 1988

[54] EARTHQUAKE-RESISTANT, REMOVABLE PARTITION

[75] Inventors: Marc Bouchon, Paris; Christian Gallois, Marly le Roi, both of France

[73] Assignee: Cogema, Compagnie Generale des Matieres Nucleaires, Velizy Villacoublay, France

[21] Appl. No.: 29,723

[22] Filed: Mar. 24, 1987

[30] Foreign Application Priority Data

Apr. 1, 1986 [FR] France ..... 86 04583

[51] Int. Cl.[4] ..... E04B 1/02

[52] U.S. Cl. ..... 52/561; 52/167; 52/593; 52/609; 376/287; 376/459

[58] Field of Search ..... 52/167, 561, 589, 593, 52/608, 609; 376/285, 287, 295, 296, 459

[56] References Cited

U.S. PATENT DOCUMENTS 1,978,585 3/1932 Orrell ..... 72/67

FOREIGN PATENT DOCUMENTS 1232638 10/1960 France .

*Primary Examiner*—Deborah L. Kyle
*Assistant Examiner*—Richard Wendtland

[57] ABSTRACT

In order to seal an opening formed in a vertical wall, a removable partition is formed, which is constituted by at least two dry-stacked brick layers. Each layer is formed from several rows of bricks, each constituted by bricks which, in cross-section, are shaped like a parallelogram, arranged in opposite directions on either side of a central locking brick which, in cross-section, is shaped like an isosceles trapezium. Each row of bricks behaves like a fictitious funicular arc when exposed to a horizontal force normal to the partition. Thus, the earthquake resistance is ensured without adding a reinforcing framework to the two faces of the partition.

8 Claims, 3 Drawing Sheets

EARTHQUAKE-RESISTANT, REMOVABLE PARTITION

BACKGROUND OF THE INVENTION

The invention relates to an earthquake-resistant replaceable or removable partition for sealing an opening formed in a vertical wall and more particularly in a wall of a room containing radioactive material.

In nuclear plants, accesses to rooms containing radioactive materials are generally sealed by partitions formed by a dry stack (without mortar) of concrete bricks.

Whilst still ensuring the continuity of protection against the radiation emitted by the radioactive material located within the room, said partitions make it possible to intervene within the room in the case of need, as a result of their dismantlable nature.

The dimensions of the opening sealed by these removable partitions vary as a function of whether they are intended to permit the passage of a person or equipment. In the first case, the dimensions are generally 1 m×1.80 m. In the case of an opening for the passage of equipment, the dimensions of the openings can be up to 5 m×4 m.

Like all elements of buildings in nuclear plants, these removable partitions are designed so that they are able to withstand the effects of an earthquake when this is made necessary by the safety analysis.

In the present state of the art, the bricks forming the removable partitions are generally in the form of rectangular parallelepipeds with planar faces. The resistance to horizontal forces of inertia perpendicular to the partition and which can be produced by an earthquake is obtained by placing a retaining framework on either side of the stack of bricks. As a function of the particular case, this framework is constituted by a general sheet metal plating or by a checkerwork of metal sections.

However, these known removable partitions suffer from a certain number of disadvantages. Firstly, the cost thereof is high, because the price of the retaining framework can be greater than that of the stack of bricks. Furthermore, access to the room is made difficult by the retaining framework, whose removal must be added to that of the stack of bricks. Finally, the presence of a retaining framework within the room makes decontamination more difficult, particularly when said framework is formed from sections. Thus, the decontamination process is made more difficult when the wall of the structure to be decontaminated is not smooth.

FR-A No. 1 232 638 discloses a partition formed from bricks, whose shape makes it possible to provide the necessary radiation protection. The bricks are mutually sealed and traversed by vertical and horizontal metal bars forming a reinforcing structure ensuring the resistance to earthquakes. However, it is not possible to dismantle this partition.

The present invention consequently relates to an earthquake-resistant, removable partition of a noval type, which does not suffer from the aforementioned disadvantages of prior art removable partitions.

SUMMARY OF THE INVENTION

Thus, the present invention specifically relates to an earthquake-resistant, removable partition closing an opening formed in a vertical wall, said partition comprising at least two layers of parallelepipedic bricks arranged in superimposed horizontal rows, wherein each of said rows comprises at least one series of bricks formed by a central locking brick having a cross-section in isosceles trapezium form, as well as bricks having a cross-section in the form of a parallelogram and arranged symmetrically on either side of the central locking brick, whereby all the central locking bricks of the same layer are oriented in the same direction, so that each of the series of bricks behaves like a fictitious funicular arc when the partition is subject to a horizontal force exerted perpendicularly to said partition in a first direction passing from the large base towards the small base of the trapezium formed in cross-section by the central locking brick of each series, the layers of bricks constituting the two outer faces of the partition being formed in such a way that the small bases of the trapeziums formed in cross-section by the central locking bricks of said layers are placed on said outer faces.

Thus, the two retaining structures according to the prior art are eliminated without prejudicing the dismantlability of the partition.

Such a removable partition is mainly designed for placing in a wall of a room containing radioactive material. However, it can also be used outside the nuclear industry, in all cases where an opening has to be relatively easily made in a vertical wall also having to have a good earthquake resistance. Thus, if the bricks are preferably made from heavy concrete with a density exceeding that of ordinary concrete, it is also possible to use other materials, such as ordinary concrete or fire clay.

Preferably the rows of bricks are vertically displaced between the individual layers, so as to prevent radiation leaks to the right of the joints. The bricks to two adjacent rows of the same layer can also be horizontally displaced in a direction parallel to the partition, so as to increase the cohesion of the latter.

In a preferred embodiment of the invention, each of the bricks with a cross-section in the form of a parallelogram has a key of one end face and a recess with a complementary shape to said key on an opposite end face, each of the bricks with a cross-section in the form of an isosceles trapezium having on end faces corresponding to the sides of the trapezium recesses with an identical shape to the recess formed on the bricks with a cross-section in the form of a parallelogram, so that in each of said rows, each key is received in a recess of the adjacent brick.

When the width of the opening in which the removable partition according to the invention is located is too large, each row of bricks comprises two series of bricks and an intermediate support brick interposed between said series and having a cross-section in the form of an isosceles trapezium, the intermediate support bricks being oriented in the opposite direction with respect to the central locking bricks of the same layer, a vertical retaining section being fixed to the wall so as to bear against the large base of the trapezium formed in section by each of the support bricks, whereof said large base is placed on an outer face of the partition.

The support bricks are then identical to the central locking bricks. It is desirable for the partition to have locking members able to simultaneously fill the recesses formed on the end faces of the support bricks and on the adjacent end faces of the bricks with a cross-section in the form of a parallelogram.

During installation, a mortar frame is poured between the bricks located on the periphery of the partition and the opening formed in the wall. To facilitate dismantling of the partition, the mortar can be replaced by a packing of unspun lead fibres between the upper row of bricks and the upper part of the opening formed in the wall.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
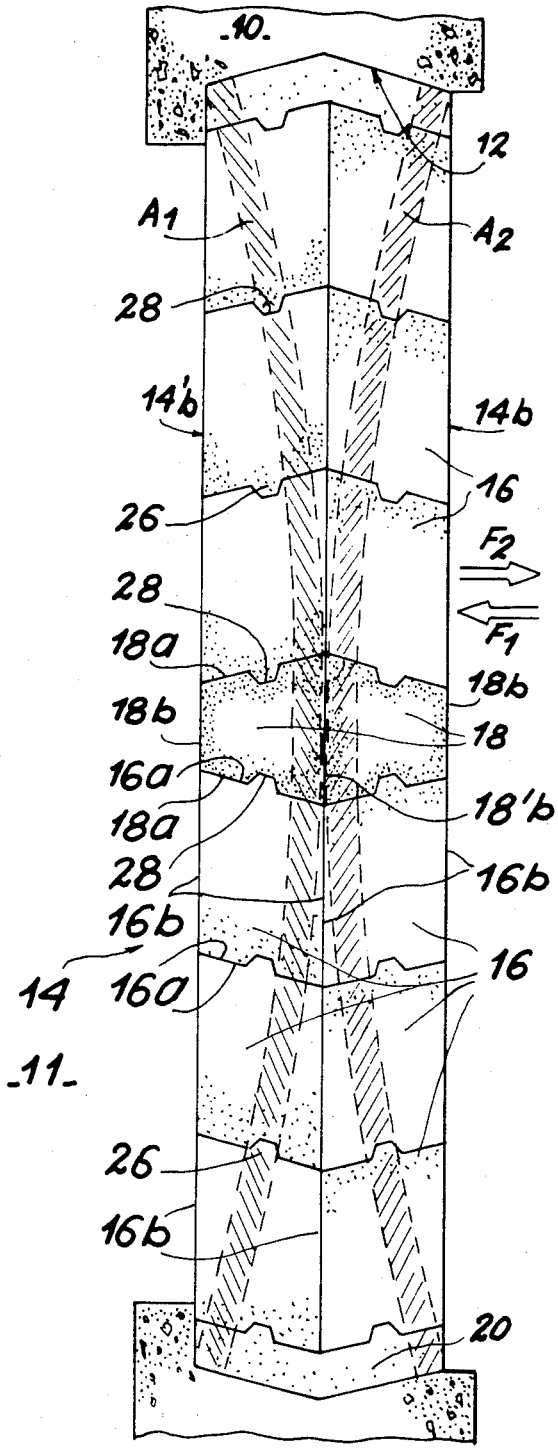
FIG. 1, a cross-sectional view illustrating a first embodiment of the removable partition according to the invention, in which the partition comprises two juxtaposed brick layers.

FIG. 1 shows an approximately vertical wall 10, e.g. of reinforced concrete, in which is made a generally rectangular opening 12. It is not vital for wall 10 to be completely vertical. Thus, it is readily apparent that the invention also applies in the case of walls having a slight inclination with respect to the vertical. Moreover, the shape of the opening 12 is not necessarily rectangular, although in general rectangular openings are normally used.

According to the invention, the opening 12 formed in wall 10 is closed or sealed by a removable partition 14 designed so as to resist earthquakes. Moreover, when wall 10 defines a room 11 containing radioactive materials, partition 14 is designed so as to provide protection against the radiation emitted by radioactive materials located within said room.

In FIG. 1, these two objectives are attained by means of a contiguous, dry stack, i.e. without mortar, of concrete bricks 16 and 18 in this case arranged in the form of two juxtaposed layers. The thickness of each of these layers is e.g. 20 or 30 cm. Each layer is formed from several horizontal rows of bricks 16, 18, all having in cross-section the shapes illustrated in FIG. 1. Bricks 16 and 18 are all parallepipedic and have planar, horizontal upper and lower faces, their height being e.g. 10 cm.

As illustrated in FIG. 1, each of the rows has a series of bricks formed from a central locking brick 18 which, in cross-section, is shaped like an isosceles trapezium and bricks 16 which, in cross-section, are shaped like parallelograms. Bricks 16 are provided in the same number and in the reverse sense on either side of the central brick 18.

On calling the adjacent faces of bricks 16, 18 of the same row the end faces, the end faces 18*a* of bricks 18 correspond to the sides of the trapeziums formed in cross-section by bricks 18. The end faces of bricks 16 are designated by reference 16*a*. The length of the bricks 16 is e.g. 10 cm and the length of bricks 18 15 to 25 cm, depending on whether they are considered from the side of the small base or the side of the large base of the trapezium which they form in cross-section.

The outer faces of bricks 16 and 18 are respectively designated by references 16*b* for bricks 16 and 18*b* and 18'*b* for the faces of bricks 18 corresponding to the small and large bases of the trapezium formed by said bricks in section. Moreover, the angles formed between faces 18*a*, 18*b* and 18'*b* of the central locking bricks 18 are the same as the angles formed between faces 16*a*, 16*b* of bricks 16. By reversing the sense of bricks 16 on either side of the central brick 18, as illustrated by FIG. 1, the end faces 16*a*, 18*a* of bricks 16, 18 of each row consequently bear on the end faces of the adjacent bricks.

In FIG. 1, each of the two layers of bricks is produced in the same way. However, the two layers of bricks are disposed in reverse senses so that the small faces of the central locking bricks 18 are located on the two outer faces 14*b*, 14'*b* of partition 14.

Figure 2:
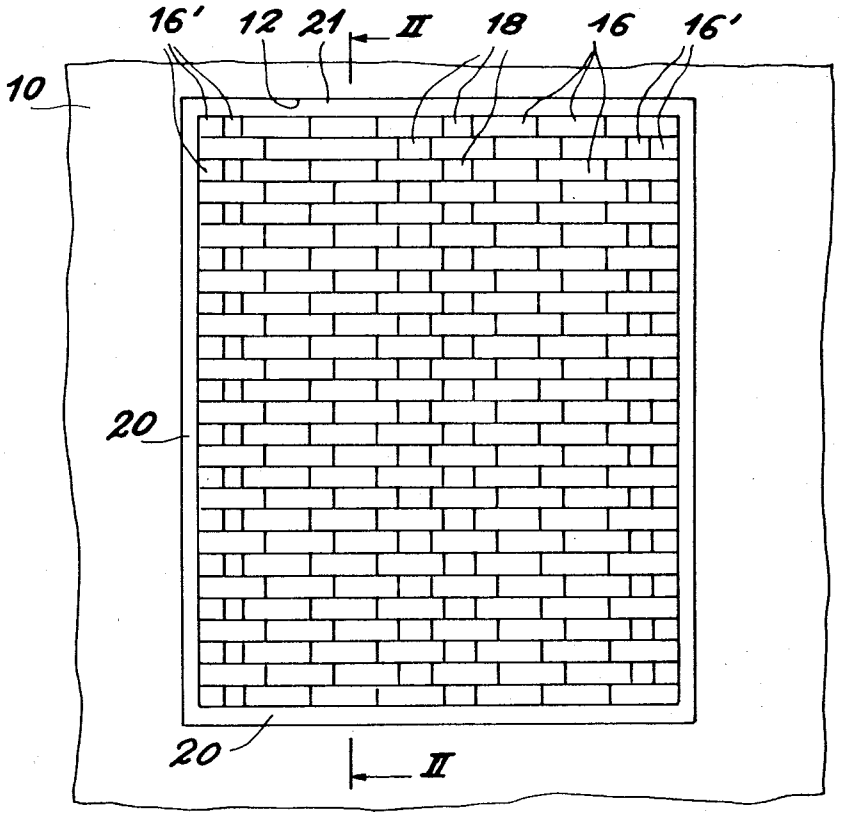
FIG. 2, a view in elevation from the inside of the room illustrating a variant of the embodiment of FIG. 1.
Figure 3:
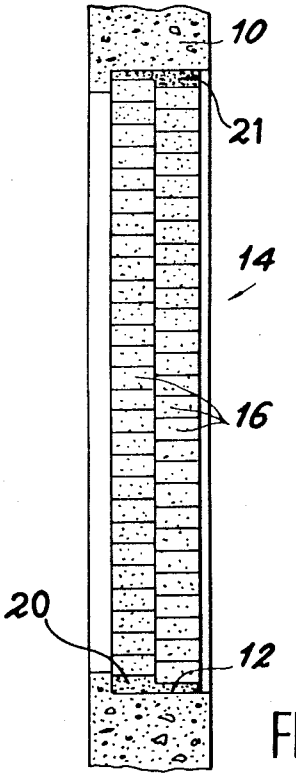
FIG. 3, a vertical sectional view along line III—III of FIG. 2.

In order that bricks 16, 18 can be installed without difficulty, there are spaces between the inner surfaces of the vertical and horizontal posts of opening 12 and the outer faces of bricks 16 placed on the periphery of partition 14. In the represented embodiment, keying mortar 20 is poured into these spaces to form horizontal beds and vertical supports, on which bears the stack of bricks. As a variant, the space defined between the upper rows of bricks and the upper horizontal post of opening 12, in which locking is unnecessary, can be filled by a packing 21 of unspun lead fibres (FIGS. 2 and 3).

As a result of the vertical supports constituted by the mortar 20 placed between the end faces 16*a* of bricks 16 placed at the ends of each row and the inner face of opening 12, which is parallel to said end faces, bricks 16 and 18 of each row of bricks behave like a fictitious funicular arc.

More specifically, the rows of bricks of one of the layers (to the left in FIG. 1) behave like a fictitious funicular arc when exposed to a horizontal load exerted perpendicularly to the partition in a first direction (arrow $F_1$ in FIG. 1). Conversely, the rows of bricks of the second layer (to the right in FIG. 1) behave like a fictitious funicular arc when the partition is exposed to a horizontal load exerted perpendicularly to the partition in the opposite direction (arrow $F_2$ in FIG. 1). The corresponding fictitious funicular arcs are diagrammatically represented by the hatched portions $A_1$ and $A_2$ in FIG. 1. In this way, no retaining framework for the removable partition is required.

As is also illustrated by FIG. 1, one of the end faces 16*a* of each of the bricks 16 preferably has a key 26 constituted by a projecting part extending vertically over the entire height of the brick and having a substantially trapezoidal shape in cross-section.

The other end face 16*a* of each of the bricks 16, as well as the two end faces 18*a* of bricks 18 have recesses 28 extending over the entire height of said bricks and having a trapezoidal cross-section. Recesses 28 have a complementary shape to that of the keys 26, so that the latter are located in the recesses of adjacent bricks 16 or 18 of the corresponding row, as illustrated in FIG. 1.

It should be noted that the keys 26 are received in recesses 28 with a certain clearance. Thus, they do not participate in the transmission of forces between the bricks, when a force is applied in accordance with arrow $F_1$ or $F_2$, as described hereinbefore. FIGS. 2 and 3 illustrate a variant of the embodiment of FIG. 1.

FIG. 2 shows that the bricks 16, 18 constituting each of the layers are arranged in staggered manner, i.e. they are displaced between individual rows, so that the joints separating them are not vertically aligned.

The consequence of this arrangement is that certain parallelepipedic bricks 16' in FIG. 2 and alternately positioned at each of the ends of rows of bricks, have a reduced length as compared with the other parallelepipedic bricks 16. The length of bricks 16' is e.g. 10 cm.

In an identical manner, FIG. 3 shows that the rows of bricks 16, 18 forming the two layers of partition 14 are vertical displaced, so that the planes of the horizontal joints between these rows are not aligned between individual layers. This vertical displacement can e.g. be a half-brick height, i.e. approximately 5 cm if the height of the bricks is approximately 10 cm.

This latter feature is of particular interest in the application of the invention to the construction of a removable partition sealing the wall of a room containing radioactive materials. Thus, it makes it possible to ensure an effective protection against the radiation emitted by said materials.

Figure 4:
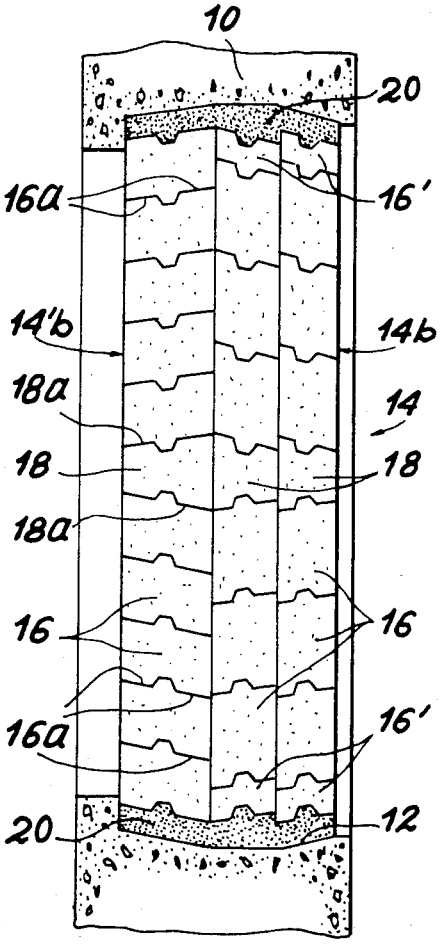
FIG. 4, a cross-sectional view identical to FIG. 1 illustrating a second embodiment of the invention, in which the removable partition comprises three juxtaposed brick layers.

FIG. 4 illustrates another embodiment of the invention comparable to that described hereinbefore with reference to FIG. 1. In this embodiment, the removable partition 14 comprises three layers of juxtaposed bricks, each of these layers being formed by superimposed, horizontal rows.

In this case, the two layers forming the outer faces **14*b* and 14'*b* of the removable partition 14 are produced in an identical manner to those of the two layers forming the partition described with reference to FIG. 1 (possibly account of the variants of FIGS. 2 and 3). With respect to the intermediate layer between the two end layers, it is produced in the same way as each of the two other layers and oriented in the same direction as one of them (the right-hand layer in FIG. 4). Bricks 16, 18 and possibly 16' constituting the partition 14** of FIG. 4 are identical to those described hereinbefore.

As is clearly shown in FIG. 4, the presence of a larger number of juxtaposed brick layers (three in this case) makes it possible to produce thicker partitions 14. Moreover, this leads to the formation between the individual layers of discontinuities between the joints formed between the end faces **16*a*, 18*a* of bricks of the same row. In the case where partition 14 seals an opening 12 formed in a wall 10** of a room containing radioactive materials, this provides an even better protection against radiation.

Obviously, as shown by FIG. 3, this protection is also insured by vertically displacing between the individual layers the horizontal joints formed between two adjacent rows of the same layer.

Figure 5:
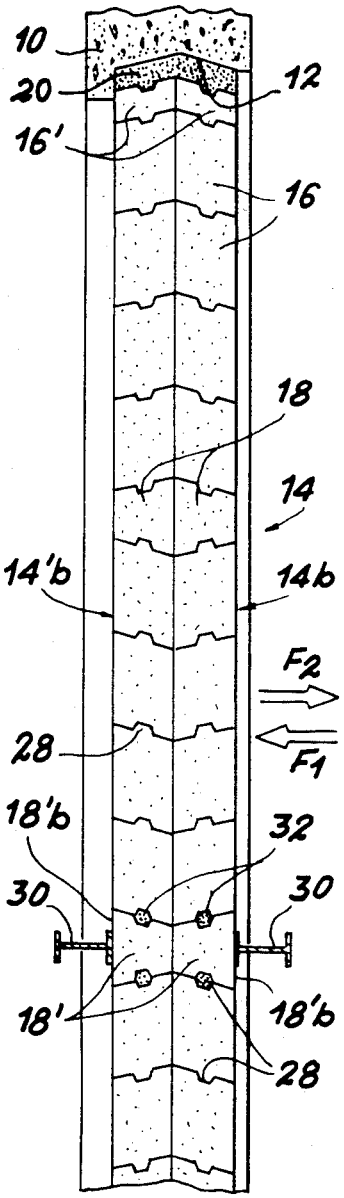
FIG. 5, a cross-section view identical to FIGS. 1 and 4 illustrating another embodiment of the invention, in which the removable partition is located in a wider opening and has an intermediate vertical support.

Finally, FIG. 5 illustrates an embodiment of the invention in which the opening 12 to be sealed by the removable partition 14 according to the invention has a width such that the mechanical strength of the vertical supports to which the forces are transmitted in the case of an earthquake cannot be ensured without the addition of an intermediate vertical support.

In practice, the maximum width between supports is chosen in such a way that the compressive stressing of the concrete of the fictitious arcs, such as $A_1$ and $A_2$ in FIG. 1, remains below a limiting stress, which is determined on the basis of the compression limit of the concrete. In the different embodiments described, in which the vertical supports comprising the keying mortar 20, which is not reinforced, not vibrated and difficulty put into place, an additional safety coefficient is applied to the compression limit of the concrete. The thus calculated maximum width is e.g. approximately 4 meters.

When the width of the opening 12 exceeds this maximum width, it is necessary to provide at least one intermediate vertical support. This situation is shown in exemplified manner in FIG. 5 in the case of a removable partition 14 having two brick layers, each formed from a certain number of rows of superimposed bricks 16, 16' and 18.

In this case, each row of bricks is formed from two identical series of bricks 16, 18 placed end to end, so as to seal the entire width of opening 12. Each of the two series of bricks of a same row is produced in an identical manner to the rows of bricks constituting the partitions described hereinbefore with reference to FIGS. 1 to 4.

More specifically, the two rows of bricks of the same row are oriented in the same direction and separated by an intermediate support brick 18' placed between the adjacent end bricks 16 of the two series. These support bricks 18' are bricks having in cross-section the shape of an isosceles trapezium. They are preferably identical to bricks 18.

Bearing in mind the orientation of the adjacent end faces of bricks 16 between which are placed the support bricks 18', the face **18'*b* thereof is located on the outer face 14*b* or 14'*b* of partition 14. Therefore, it is necessary to provide supports for transmitting to wall 10 the forces collected by bricks 18'** in the case of an earthquake.

As illustrated by FIG. 5, these supports are preferably constituted by vertical sections 30 e.g. in the form of I-sections, positioned so as to be able to withstand a force exerted perpendicularly to the partition respectively in the direction of arrow $F_1$ or $F_2$. Sections 30 are sealed at the top and bottom of concrete wall 10 and are in contact with the faces **18'*b* of bricks 18'**.

In this way, when a force is exerted perpendicularly in the direction of arrows $F_1$ or $F_2$ in FIG. 5, one or other of the layers of bricks forming partition 14 behaves, row by row, in the manner of two fictitious funicular arcs transmitting the force to which they are exposed half to the vertical inner edges of opening 12 via the keying concrete 20 and half to section 24 via the support bricks 18'.

As can be seen from FIG. 5, when the support bricks 18' are identical to the intermediate bricks 18, the recesses 18 formed on the end faces of said bricks 18' face corresponding recesses 28 formed on the adjacent end faces of bricks 16. It is then desirable to place in the recesses facing bricks 16, 18', locking members 32 which simultaneously fill the two facing recesses.

It should be noted that the retaining sections 30 are very widely spaced and that their cost is well below that of the retaining framework required by the prior art.

Obviously the invention is not limited to the embodiments described in exemplified manner hereinbefore and covers all variants thereof.

In particular, the embodiment described can be combined with one another, whereby the use of intermediate vertical supports described with reference to FIG. 4 can be also applied to a partition formed from two layers of bricks, or to a partition formed from three layers of bricks. Moreover, the keys formed on the bricks in the embodiments described only have a safety function and, if necessary, can be eliminated.

Moreover, although the invention is particularly adapted to the case of removable partitions provided for sealing openings formed in the walls of rooms containing radioactive materials, it can also be used outside the nuclear industry.

Finally, the use of keying mortar can be avoided and replaced by complementary bricks with appropriate dimensions. The locking of the system is then assured by means of at least one brick produced in several parts linked with one another by a dismantlable connecting or linking means accessible from the outside, such as a screw.

What is claimed is:

1. An earthquake-resistant, removable partition closing an opening formed in a vertical wall, said partition comprising at least two layers of parallelepipedic bricks arranged in superimposed horizontal rows, wherein each of said rows comprises at least one series of bricks formed by a central locking brick having a cross-section in isosceles trapezium form, as well as bricks having a cross-section in the form of a parallelogram and arranged symmetrically on either side of the central locking brick, whereby all the central locking bricks of the same layer are oriented in the same direction, so that each of the series of bricks behaves like a fictitious funicular arc when the partition is subject to as horizontal force exerted perpendicularly to said partition in a first direction passing from the large base towards the small base of the trapezium formed in cross-section by the central locking brick of each series, the layers of bricks constituting the two outer faces of the partition being formed in such a way that the small bases of the trapeziums formed in cross-section by the central locking bricks of said layers are placed on said outer faces.

2. A partition according to claim 1, wherein the rows of bricks are vertically displaced between individual rows.

3. A partition according to claim 1, wherein the bricks of two adjacent rows of a same layer are horizontally displaced parallel to said partition.

4. A partition according to claim 1, wherein each of the bricks with a cross-section in the form of a parallelogram has a key of one end face and a recess with a complementary shape to said key on an opposite end face, each of the bricks with a cross-section in the form of an isosceles trapezium having on end faces corresponding to the sides of the trapezium recesses with an indentical shape to the recess formed on the bricks with a cross-section in the form of a parallelogram, so that in each of said rows, each key is received in a recess of the adjacent brick.

5. A partition according to claim 1, wherein each row of bricks comprises two series of bricks and an intermediate support brick interposed between said series and having a cross-section in the form of an isosceles trapezium, the intermediate support bricks being oriented in the opposite direction with respect to the central locking bricks of the same layer, a vertical retaining section being fixed to the wall so as to bear against the large base of the trapezium formed in section by each of the support bricks, whereof said large base is placed on an outer face of the partition.

6. A partition according to claim 5, wherein the support bricks are identical to the central locking bricks, said partition having locking member able to simultaneously fill the recesses formed on the end faces of the support bricks and on the adjacent end faces of the bricks, which are parallelogram-shaped in cross-section.

7. A partition according to claim 1, wherein the opening formed in the wall is defined by a mortar frame poured on bricks placed on the periphery of said partition.

8. A partition according to claim 7, wherein the mortar frame is completed, between the upper row of bricks and an upper horizontal post of the opening, by a packing of unspun lead fibres.

* * * * *